US005769312A

United States Patent [19]

Lampe

[11] Patent Number: 5,769,312

[45] Date of Patent: Jun. 23, 1998

[54] MAILBOX HAVING DUAL ACCESS CLOSURES AND INTERLOCKED SIGNALLING MEANS

[76] Inventor: Thomas F. Lampe, 3371 Paxton Ct., Marietta, Ga. 30066

[21] Appl. No.: 762,841

[22] Filed: Dec. 10, 1996

[51] Int. Cl.[6] ..... B65D 91/00

[52] U.S. Cl. ..... 232/35; 232/45

[58] Field of Search ..... 232/17, 35, 43.4, 232/45

[56] References Cited

U.S. PATENT DOCUMENTS

| | | | |
|---|---|---|---|
| D. 315,821 | 3/1991 | Lorenzi . | |
| D. 332,166 | 12/1992 | Williams . | |
| 3,106,335 | 10/1963 | Allan . | |
| 4,005,816 | 2/1977 | Malik . | |
| 4,220,278 | 9/1980 | Hasselbring . | |
| 4,382,540 | 5/1983 | Kelly et al. . | |
| 4,447,005 | 5/1984 | Kelly et al. | 232/43.4 X |
| 4,508,259 | 4/1985 | Hicks . | |
| 4,848,650 | 7/1989 | Roberts, II . | |
| 5,056,711 | 10/1991 | Bush . | |

*Primary Examiner*—Blair Johnson
*Attorney, Agent, or Firm*—Hinkle & Associates, P.C.

[57] ABSTRACT

A dual access mailbox 2 has front and rear closures 20 and 22 which actuate a signal member 28 from a non-signalling position to a signalling position and from a signalling position to a non-signalling position. A first arm 52 is pivotally mounted to the front closure and a second arm 54 is pivotally mounted to the second closure. Both arms are pivotally and slidably mounted to the signal member. As the front closure is moved to the open position, the first arm engages the signal member and pivots the signal member to the signalling position, and as the second closure is moved to the open position, the second arm engages the signal member and pivots the signal member to the non-signalling position.

13 Claims, 2 Drawing Sheets

4
26
20
16
36
2
12
8
42
64
48
24
18
50
46
28
56
26
30
32
66
58
52
64
62
74
22
23
24
60
66
54

26
20
16
4
12
8
2
18
64
24
84
10
32
58
62
44
6
28
56
66
14
52
22
36
80
74
48
42
66
24
60
54
64
26

MAILBOX HAVING DUAL ACCESS CLOSURES AND INTERLOCKED SIGNALLING MEANS

BACKGROUND OF THE INVENTION

I. Field of the Invention

The present invention relates generally to the field of double door mailboxes. More particularly, the present invention relates to a mailbox having interconnected front and rear closures and a signalling device actuated by movement of the respective closures.

II. Description of the Related Art

Dual access mailboxes are known in the art. In regions utilizing mailboxes located adjacent to street curbs, a mail recipient having the dual access mailbox does not have to leave the curb area and step into the street to either place outgoing mail into or retrieve delivered mail from the mailbox. The recipient simply opens the door or closure facing away from the street to gain access to the mailbox. Often, the recipient desires to know whether a postal carrier has left mail in the mailbox without actually inspecting the interior of the mailbox. In the past this has been accomplished by use of various flags, mailbox windows and visual, signalling devices.

A Mailbox Having Dual Access Closures and Signal Means described in U.S. Pat. No. 4,005,816 by Malik has a double closure mailbox with a closure actuated signal device. Each end of the mailbox has a hinged closure, and the signal device is pivotally mounted to a side of the mailbox. A rod is pivotally mounted to the signal device at one end and slidingly mounted to a plate extending from a front closure. As the front closure is opened, the signal device pivots upwardly to a signalling position. As the front door is closed, the rod slides within a bore of the plate and permits the signal device to remain in the signalling position. A rear door is connected to the signal device by a chain. Moving the rear door into an open position causes the chain to pull the signal device to a point so that gravity causes the signal device to pivot and fall into a non-signalling position.

U.S. Pat. No. 4,220,278 granted to Hasselbring describes a double door mailbox. This mailbox has front and rear doors that are connected to an elongated rod member. The rod member has a front link rod connected to the front door that slidably engages a rear link rod connected to the rear door. The link rods are connected to each other by a lost motion structure to permit either door to be opened or closed while the opposite door is closed. A signal member slidably engages the intermediate portions of both link rods so that movement of either link member toward the opposite door moves the signal member, located within the mailbox, a corresponding distance. The signal member is oriented so that opening of the front door causes the signal member to move forwardly to its retracted position, indicating to the recipient that mail has arrived. In its protracted position, the signal member is visible through a rear door window, indicating that mail has not arrived.

SUMMARY OF THE INVENTION

In accordance with the present invention and the contemplated problems which have and continue to exist in this field, the objectives of this invention are to provide a mailbox having dual access closures and interlocked signalling means which:

has dual access closures on both ends of a mailbox housing;

has an actuating signal member that moves from a signalling position to a non-signalling position and vice versa upon movement of the closures;

connects the signal member to the front and rear closures by first and second arms, respectively; and has at least one divider disposed with the mailbox.

This invention accomplishes the above and other objectives and overcomes the disadvantages of the prior art by providing a mailbox having dual access closures and interlocked signalling means that is simple in design and construction, inexpensive to fabricate, and easy to use. The mailbox has front and rear closures which actuate a signal member from a non-signalling position to a signalling position and from a signalling position to a non-signalling position. A first arm is pivotally mounted to the front closure and a second arm is pivotally mounted to the second closure. Both arms are pivotally and slidably mounted to the signal member. As the front closure is moved to the open position, the first arm engages the signal member and pivots the signal member to the signalling position, and as the second closure is moved to the open position, the second arm engages the signal member and pivots the signal member to the non-signalling position.

It is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Other objects, advantages and capabilities of the invention will become apparent from the following description taken in conjunction with the accompanying drawings showing the preferred embodiment of the invention.

BRIEF DESCRIPTION OF THE DRAWINGS

The invention will be better understood and the above objects as well as objects other than those set forth above will become apparent when consideration is given to the following detailed description thereof. Such description makes reference to the annexed drawings wherein.

DESCRIPTION OF THE PREFERRED EMBODIMENTS

Figure 1:
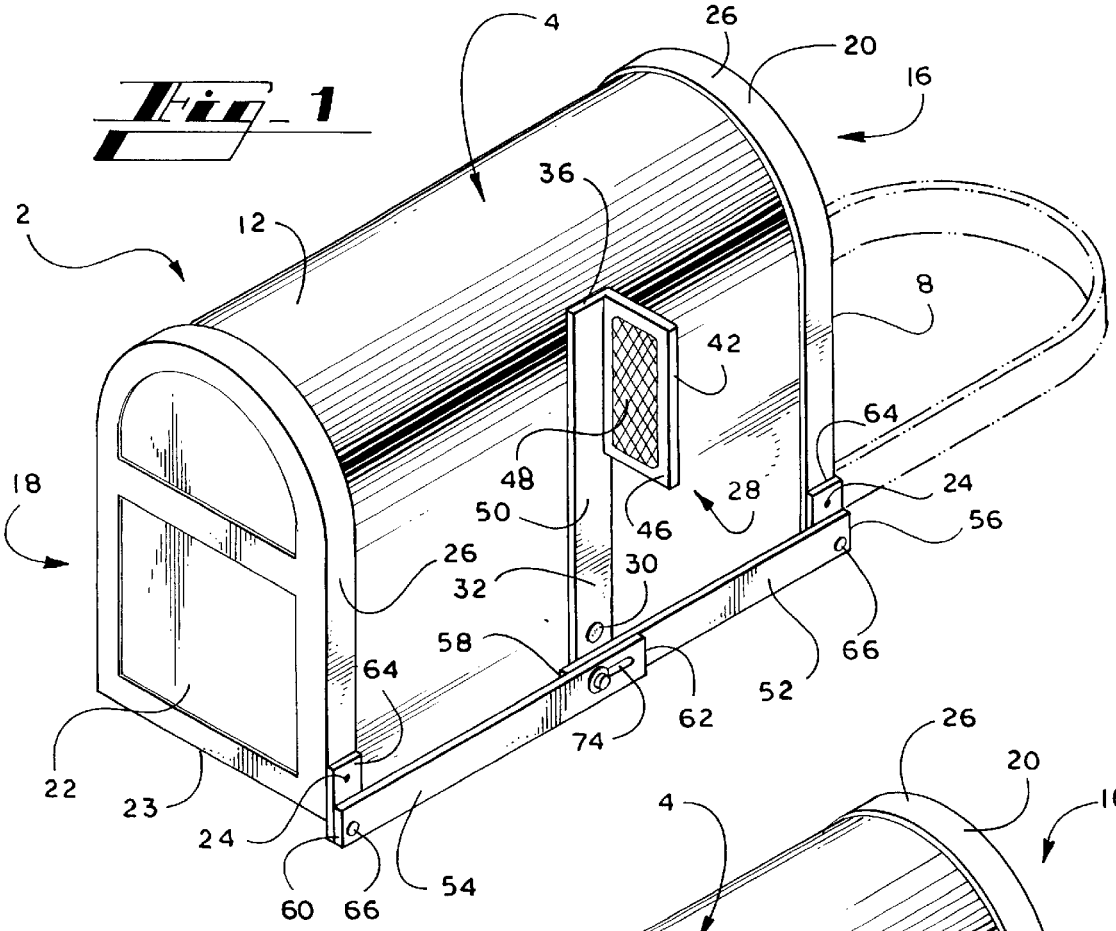
FIG. 1 is a perspective view of a mailbox having dual access closures and interlocked signalling means constructed in accordance with the present invention and illustrates a signal member in a signalling position.
Figure 2:
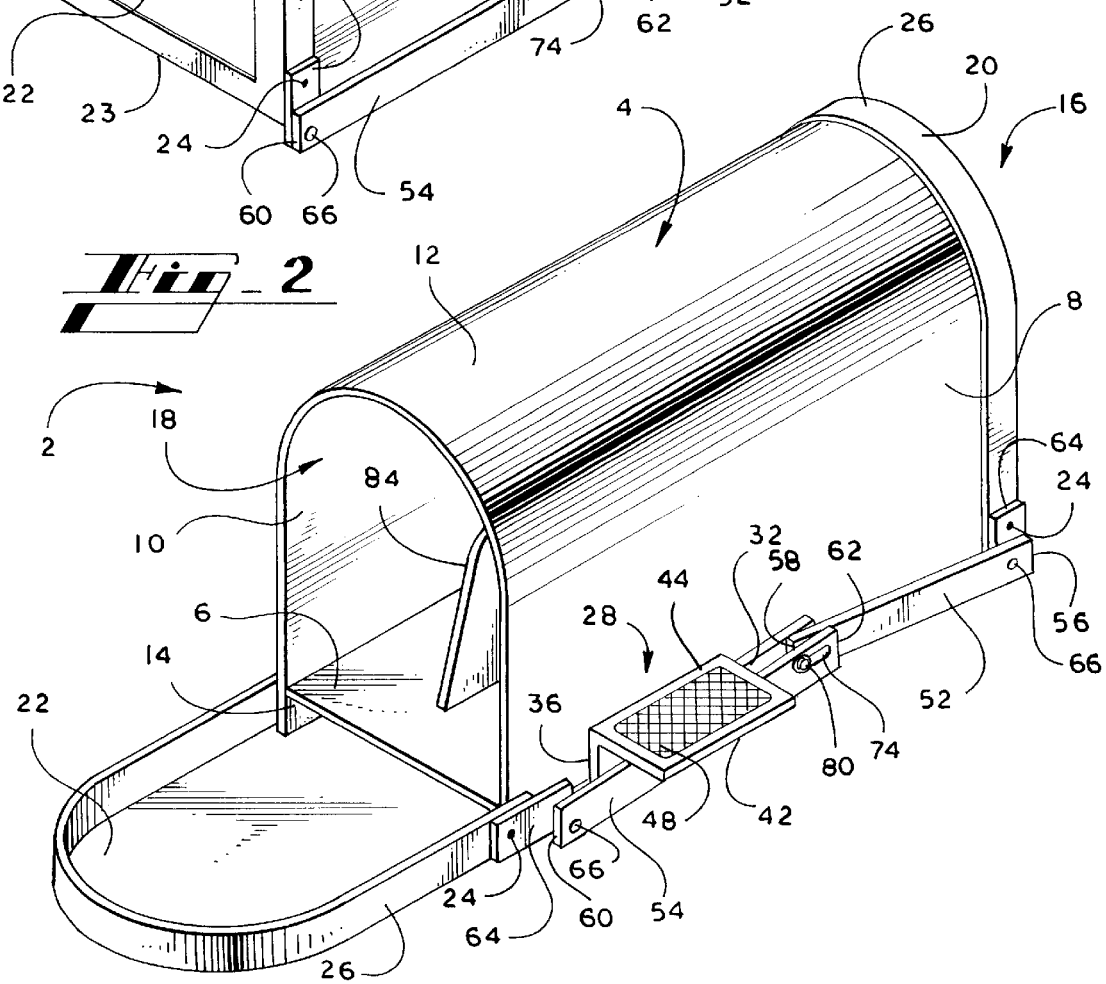
FIG. 2 is a perspective view of the mailbox of FIG. 1 and illustrates the opening of the rear closure and the lowering of the signal member.
Figure 3:
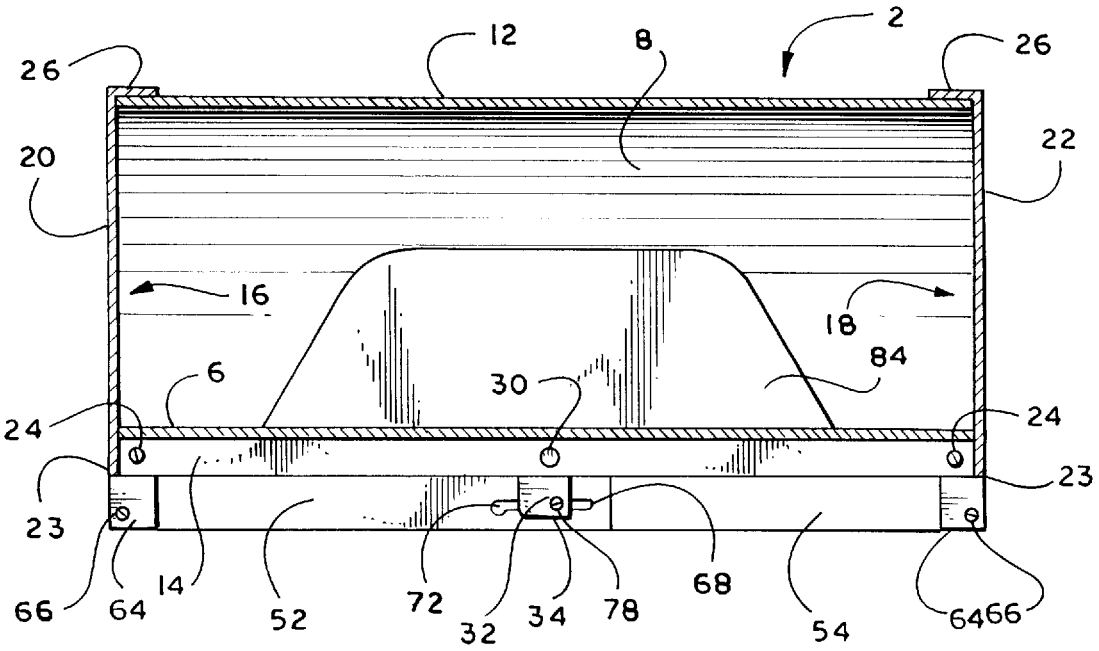
FIG. 3 is a partial, elevation view of the mailbox of FIG. 1 and illustrates a divider.

For a fuller understanding of the nature and desired objects of this invention, reference should be made to the following detailed description taken in connection with the accompanying drawings. Referring to the drawings wherein like reference numerals designate corresponding parts throughout the several figures, reference is made first to FIGS. 1 and 2. FIGS. 1 and 2 of the drawings illustrate a dual access mailbox 2 constructed in accordance with the present invention. The mailbox 2 has an elongated mailbox housing 4 of conventional shape having a floor 6, a first side wall 8, a second side wall 10 and an arched top wall 12. As shown in FIGS. 2 and 3, the first and second side walls 8 and 10 extend beyond the floor 6 to form mounting shoulders 14 which are used to mount the mailbox 2 to a predetermined support structure (not shown). The housing 4 includes a front access opening 16 and a rear access opening 18.

Adapted to open and close the front access opening 16 in a conventional manner is a front closure 20. A similarly constructed rear closure 22 is adapted to open and close the rear access opening 18. The front and rear closures 20 and 22 are hinged along their bottom edges 23 to the corresponding portions of the floor by hinge pins 24. Depending from the periphery of each of the front and rear closures 20 and 22 is a sealing rim 26 that matingly and removably engages the housing 4 to prevent atmospheric elements, such as rain or snow, from entering the interior of the mailbox 2.

Figure 4:
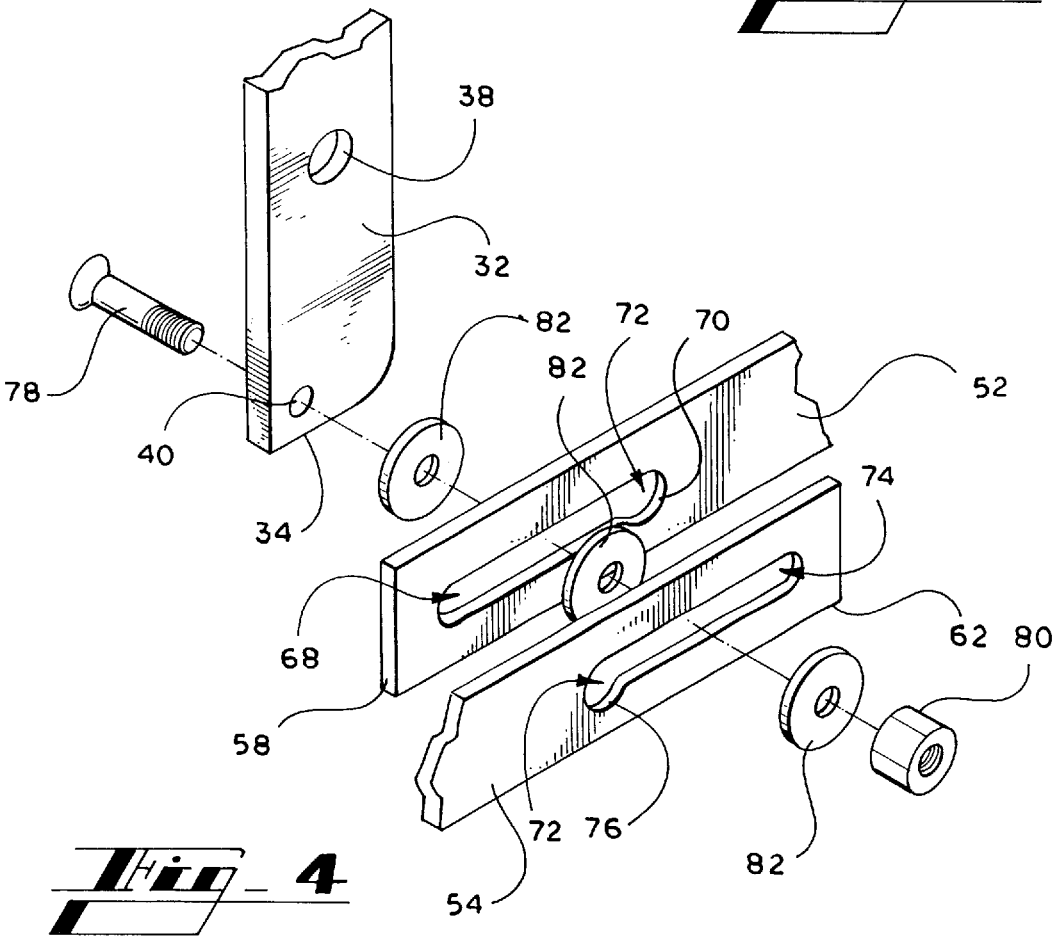
FIG. 4 is a partial and exploded, perspective view of the mailbox of FIG. 1 and illustrates a first arm, a second arm, a staff and a post.

Referring additionally to FIG. 4, a signal member 28 is pivotally mounted to the housing 4 by a pivot pin 30. It is preferred for the pivot pin 30 to have a hollow center for permitting mounting hardware (not shown) to be inserted through the pivot pin 30 into the support structure. The signal member 28 is movable between a standing signalling position, as shown in FIG. 1, and a lying non-signalling position, as shown in FIG. 2. In the preferred embodiment, the signal member 28 has an elongated staff 32 having a pivot end 34 and a distal end 36. Proximate the pivot end 34, the staff 32 has a pivot bore 38 and is pivotally mounted to the first side wall 8 by the pivot pin 30 which is disposed through the pivot bore 38. The pivot end 34 extends beyond the pivot bore 38 in an opposite direction from the distal end 36. Located at the pivot end 38 is an interlocking bore 40, as shown in FIG. 4.

Proximate the distal end 36 is a substantially rectangularly-shaped, planar head 42 that depends from the staff 32. In the preferred embodiment, the head 42 extends substantially perpendicular to and away from the housing 4 to improve viewability of the signal member 28. On opposite sides of the head 42, the head 42 has a front face 44 and a rear face 46. Mounted to the front and rear faces 44 and 46 is a light-reflecting member 48. Devices suitable for use as the light-reflecting member 48 are brightly colored or reflective paints, tapes, strips and the like. Preferably, light-reflecting lenses are mounted to the front and rear faces 44 and 46 by conventional means. Disposed upon and extending outwardly from the staff 32 is a stop 50, which is further described below. It is not required for the signal member 28 to have the head 42 or have the head 42 in the preferred configuration. Conventional signal members 28, also known conventionally as "mailbox flags", are suitable for use and are considered a part of the invention.

Referring now to FIGS. 1, 2 and 4, the mailbox 2 has an elongated first arm 52 and an elongated second arm 54 operatively connected to the front and rear closures 20 and 22, respectively. The first arm 52 has a first end 56 and a second end 58, and the second arm 54 has a first end 60 and a second end 62.

Levers 64 depend from the sealing rim 26 of the front and rear closures 20 and 22 proximate the hinge pins 24 adjacent to the first side wall 8. Although not required, each lever 64 extends beyond the bottom edge 23 of the respective closure 20 and 22 and has a lever bore (not shown). Proximate the first end 56 of the first arm 52 is a first arm bore (not shown). The first arm 52 is pivotally mounted to the lever 64 of the front closure 20 by a lever pin 66 disposed through the lever bore and the first arm bore. Proximate the first end 60 of the second arm 54 is a second arm bore (not shown). Likewise, the second arm 54 is pivotally mounted to the lever 64 of the rear closure 22 by another lever pin 66 disposed throughout the lever bore and the second arm bore.

To actuate the signal member 28 between the signalling position and the non-signalling position by movement of the closures 20 and 22, the first and second arms 52 and 54 are operatively connected to the staff 32 of the signal member 28. Preferably, the first and second arms 52 and 54 are operatively connected to the staff 32 between the pivot bore 38 and the pivot end 34. The first arm 52 has a first slot 68 proximate the second end 58. Distally located from the second end 58 within the first slot 68 is a first engaging surface 70 and a detent 72 disposed adjacent the first engaging surface 70. Also, the second arm 54 has a second slot 74 proximate the second end 62. Distally located from the second end 62 within the second slot 74 is a second engaging surface 76 and another detent 72 disposed adjacent the second engaging surface 76. Extending outwardly from the staff 32 of the signal member 28 is a post 78. The post 78 is disposed through and slidably engages the first and second slots 68 and 74. As shown in FIG. 4, the post 78 is a threaded bolt which is secured onto the first and second arms 52 and 54 by a locking nut 80. In the preferred embodiment washers 82 are mounted onto the post 78 and disposed between the staff 32 and the first arm 52, the first arm 52 and the second arm 54, and the second arm 54 and the locking nut 80.

In this arrangement as the front closure 20 is moved to the open position, the first engaging surface 70 engages and pushes the post 78 and pivots the signal member 28 to the signalling position. Upon the signal member 28 reaching the signalling position, the detents 72 of the first and second slots 68 and 74 align and gravity causes the post 78 to drop into the detents 72, thereby adding stability for the signal member to remain in the signalling position. Due to the length of the slots 68 and 74, the front closure 20 can be moved to the closed position without causing the signal member 28 to move from the signalling position. Conversely, as the rear closure 22 is moved to the open position, the second engaging surface 76 engages and pushes the post 78 and pivots the signal member 28 to the non-signalling position. The rear closure 22 can be moved to the closed position without causing the signal member 28 to be moved into the signalling position. To prevent the staff 32 from over-pivoting, the stop 50 engages the second arm 54. Additionally, one of the closures 20 and 22 must remain in the closed position while the other is moved into the open position.

Disposed within the housing 4 is a divider 84. The divider 84 extends upwardly from the floor 6 and can be removably mounted to the floor 6. In the embodiment shown in FIGS. 2 and 3, only one divider 84 is disposed within the housing 4. However, an embodiment having a plurality of dividers 84 is envisioned and, therefore, considered a part of this invention.

Although not particularly shown, another signal member 28 can be pivotally mounted to the second side wall 10 in the same manner as the signal number 28 is pivotally mounted to the first side wall 8. This signal member 28 is also movable between a non-signalling position and a signalling position. To actuate this signal member 28 from the signalling position to the non-signalling position upon movement of the front closure 20 to the open position, the mailbox 2 generally has the same configuration as detailed above. The exception is that the first arm 52 is not needed at the second side wall 10 and is therefore absent. Particularly, another second arm 54 having the elements described above is pivotally mounted to the lever 64 adjacent the hinge pin 24 at the front closure 20 on the second wall side 10. The signal member 28 is movably mounted to this second arm 54 in the same manner as described above. All other features described above remain the same.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, various modifications may be made of the invention without departing from the scope thereof and it is desired, therefore, that only such limality of teeth having no hair-lifting formations thereon.

Various modifications may be made of the invention without departing from the scope thereof and it is desired, therefore, that only such limitations shall be placed thereon as are imposed by the prior art and which are set forth in the appended claims.

What is claimed is:

1. A dual access mailbox, comprising:

an elongated mailbox housing having a front access opening and a rear access opening;

a front closure on the housing movable toward and away from the front access opening between a closed position and an open position;

a rear closure on the housing movable toward and away from the rear access opening between a closed position and an open position;

a signal member pivotally mounted to the housing, the signal member being movable between a non-signalling position and a signalling position, the signal member having a post extending outwardly therefrom;

an elongated first arm having a first end, a second end and a first slot proximate the second end to receive and slidably engage the post, the first end of the first arm being pivotally mounted to the front closure, the first slot having a first engaging surface;

an elongated second arm having a first end, a second end and a second slot proximate the second end to receive and slidably engage the post, the first end of the second arm being pivotally mounted to the rear closure, the second slot having a second engaging surface, whereby as the front closure is moved to the open position the first engaging surface engages the post and pivots the signal member to the signalling position and as the second closure is moved to the open position the second engaging surface engages the post and pivots the signal member to the non-signalling position.

2. A mailbox as claimed in claim 1, wherein the first and second slots have a detent adjacent the first and second engaging surfaces, respectively.

3. A mailbox as claimed in claim 1, wherein the signal member has an elongated staff and a head depending from the staff.

4. A mailbox as claimed in claim 3, wherein the head has a front face and a rear face, and the front and rear faces have light-reflecting members mounted thereto.

5. A mailbox as claimed in claim 3, herein the head defines a plane and the plane is substantially perpendicular to the housing.

6. A mailbox as claimed in claim 3, wherein the staff has a stop extending outwardly from the staff for engaging the second arm while the signal member is in the non-signalling position.

7. A mailbox as claimed in claim 1, wherein the housing has a floor and further comprises at least one divider extending upwardly from the floor within the housing.

8. A mailbox as claimed in claim 1, wherein the housing has a first side wall and a second side wall, and the signal member is pivotally mounted to the first side wall.

9. A dual access mailbox, comprising:

an elongated mailbox housing having a front access opening, a rear access opening, a first side wall and a second side wall;

a front closure on the housing movable toward and away from the front access opening between a closed position and an open position;

a rear closure on the housing movable toward and away from the rear access opening between a closed position and an open position;

a first signal member pivotally mounted to the first side wall, the signal member being movable between a non-signalling position and a signalling position;

a second signal member pivotally mounted to the second side wall an elongated first arm having a first end and a second end, the first end of the first arm being pivotally mounted to the front closure;

an elongated second arm having a first end and a second end, the first end of the second arm being pivotally mounted to the rear closure; and interlocked signalling means operatively connecting the second end of the first arm, the second end of the second arm and the first signal member for moving the first signal member from the non-signalling position to the signalling position upon movement of the front closure to the open position and moving the first signal member from the signalling position to the non-signalling position upon movement of the rear closure to the open position.

10. A mailbox as claimed in claim 9, wherein the second signal member is movable between a non-signalling position and a signalling position.

11. A mailbox as claimed in claim 10, wherein the second signal member is operatively connected to the front closure to move the signal member from the signalling position to the non-signalling position upon movement of the front closure to the open position.

12. A dual access mailbox, comprising:

an elongated mailbox housing having a front access opening and a rear access opening;

a front closure on the housing movable toward and away from the front access opening between a closed position and an open position;

a rear closure on the housing movable toward and away from the rear access opening between a closed position and an open position;

a signal member pivotally mounted to the housing, the signal member being movable between a non-signalling position and a signalling position;

an elongated first arm having a first end and a second end, the first end of the first arm being pivotally mounted to the front closure;

an elongated second arm having a first end and a second end, the first end of the second arm being pivotally mounted to the rear closure; and interlocked signalling means operatively connecting the second end of the first arm, the second end of the second arm and the signal member for pushing the signal member from the non-signalling position to the signalling position upon movement of the front closure to the open position and moving the signal member from the signalling position to the non-signalling position upon movement of the rear closure to the open position.

13. A dual access mailbox, comprising:

an elongated mailbox housing having a front access opening and a rear access opening;

a front closure on the housing movable toward and away from the front access opening between a closed position and an open position;

a rear closure on the housing movable toward and away from the rear access opening between a closed position and an open position;

a signal member pivotally mounted to the housing, the signal member being movable between a non-signalling position and a signalling position;

an elongated first arm having a first end and a second end, the first end of the first arm being pivotally mounted to the front closure;

an elongated second arm having a first end and a second end, the first end of the second arm being pivotally mounted to the rear closure; and interlocked signalling means operatively connecting the second end of the first arm, the second end of the second arm and the signal member for moving the signal member from the non-signalling position to the signalling position upon movement of the front closure to the open position and pushing the signal member from the signalling position to the non-signalling position upon movement of the rear closure to the open position.

* * * * *